United States Patent [19]

Papez

[11] Patent Number: 4,517,934

[45] Date of Patent: May 21, 1985

[54] CONTROLLABLE CAMSHAFT FOR A DRIVE, PREFERABLY AN INTERNAL COMBUSTION ENGINE

[75] Inventor: Stanislav Papez, Wolfsburg, Fed. Rep. of Germany

[73] Assignee: Volkswagenwerk Aktiengesellschaft, Wolfsburg, Fed. Rep. of Germany

[21] Appl. No.: 170,073

[22] Filed: Jul. 18, 1980

Related U.S. Application Data

[63] Continuation-in-part of Ser. No. 37,697, May 10, 1979, Pat. No. 4,332,222.

[30] Foreign Application Priority Data

Jul. 26, 1979 [DE] Fed. Rep. of Germany ..... 2930266

[51] Int. Cl.[3] ..... F01L 1/08; F01L 1/34

[52] U.S. Cl. ..... 123/90.17; 464/2

[58] Field of Search ..... 123/90.15, 90.17, 90.31, 123/146.5 A, 426, 501, 502; 318/560, 609, 610, 671; 464/2

[56] References Cited

U.S. PATENT DOCUMENTS

| | | | |
|---|---|---|---|
| 3,496,918 | 2/1970 | Finlay | 123/90.15 |
| 3,516,394 | 6/1970 | Nichols | 123/90.17 |
| 3,815,564 | 6/1974 | Suda et al. | 123/501 |
| 3,978,829 | 9/1976 | Takahashi et al. | 123/90.15 |
| 4,158,350 | 6/1979 | Moller et al. | 123/426 |

FOREIGN PATENT DOCUMENTS

| | | | |
|---|---|---|---|
| 1109790 | 2/1956 | France | 123/90.17 |

*Primary Examiner*—Parshotam S. Lall
*Assistant Examiner*—W. R. Wolfe
*Attorney, Agent, or Firm*—Brumbaugh, Graves, Donohue & Raymond

[57] ABSTRACT

A camshaft for the drive of an internal combustion engine has a hollow shaft carrying one or more cams or partial cams and an inner shaft disposed within the hollow shafts and rotatable relative to the hollow shaft. The inner shaft has one or more cams or partial cams disposed outside the hollow shaft and attached for rotation with the inner shaft through clearances in the hollow shaft. A camshaft driving arrangement includes a camshaft timing gear coupled with both shafts and a device responsive to a parameter characteristic of the operating conditions of the drive for adjusting the rotational position of either one or both of the inner and hollow shafts relative to the camshaft timing gear. The adjusting device includes an electric motor fixed on the timing gear and controlled by electrical signals. The motor acts on a threaded spindle which meshes with a counterthread surface on the inner shaft or the outer shaft, or both, for adjusting the relative position of the shaft or shafts relative to top dead center.

6 Claims, 4 Drawing Figures

CONTROLLABLE CAMSHAFT FOR A DRIVE, PREFERABLY AN INTERNAL COMBUSTION ENGINE

This application is a continuation-in-part of pending U.S. application Ser. No. 037,697, filed May 10, 1979 now U.S. Pat. No. 4,332,222.

BACKGROUND OF THE INVENTION

The present invention relates to a controllable camshaft for a drive preferably an internal combustion engine.

In a four stroke internal combustion engine, the shapes of the cams actuating the engine inlet and exhaust valves determine the timing of the intake and exhaust valves relative to the top dead center of the piston movements. The particular cam shapes, therefore, affect the engine output torque gradient, instantaneous engine speed, idling, fuel consumption, and exhaust emissions of the engine. In addition to the opening times, the shapes of the cams also determine the time the valves remain open, which likewise affects operation. With narrow intake cams, the intake valves can be controlled to ensure optimum mixture delivery at low engine speed. On the other hand, better engine output is achieved at higher speeds with a wider (peak) cam, but a torque loss results at lower speeds.

Control of the timing of the engine valves also influences the exhaust gas emissions. The sooner the exhaust valves open, the sooner the oxidation process in the combustion chamber is interrupted, and the larger the resulting hydrocarbons in the exhaust gas. If the exhaust valve closes earlier, or the intake valve opening time is advanced, the proportion of the residual gas in the exhaust gas increases and $NO_x$ is reduced. The closing time of the intake valves, however, has relatively little effect on exhaust gas emissions.

In previous designs, the engine conditions resulting from different control times of the intake and exhaust valves were considered separately. The overlap time of the opening of the intake and exhaust valves, however, also affects the exhaust gas make-up. A large overlap at top dead center results in rough idling and increased fuel consumption during idling, and the exhaust gases contain a higher share of hydrocarbons and carbon monoxide with lower $NO_x$. By decreasing the overlap, idling is improved, and there is a resulting decrease in fuel consumption, hydrocarbons, and carbon monoxide. In a diesel engine, on the other hand, a large overlap in top dead center may be desired to reduce knocking at cold temperatures.

As a result of these considerations, intake and exhaust cams are normally provided with distances between peaks which constitute a compromise for the various speeds and operating loads of the engine.

German OS No. 1,924,114 discloses a camshaft for an internal combustion engine in which the width of the cam is varied in accordance with engine speed. The operating cams each consist of two partial cams, one of which is carried on an outside hollow shaft, the other is carried on a rotatable inner shaft. By pivoting the shafts relative to each other, the width of the compound cam is changed. One of the shafts is rigidly connected to the drive gear for the camshaft. A centrifugal regulator has a cresent shaped weight which with increased engine speed (and thus camshaft rpm) swivels about an eccentric center of mass on the drive gear in opposition to the force of a counter-spring. The motion of the weight is transmitted by a rod system to the other of the two shafts which is not rigidly coupled with the driving gear. This arrangement requires a complex structure, and the relative pivoting is not freely adjustable but is determined by the spring constant of the counter-spring and the mass of the centrifugal regulator weight.

German OS No. 1,947,362 discloses a camshaft in which the distance between the intake and exhaust cam peaks may be modified as a function of engine speed. The device has a pair of aligned shafts whose ends in the region of the timing drive gear are coupled by spacer segments. A centrifugal governor, having springs and a weight, is interposed between the segments to couple the segments. This arrangement necessitates a predetermined relative position of the intake and exhaust valves, and without a separate arrangement, provides only relative pivoting of the two shafts and not independent pivoting relative to top dead center of the engine piston. Also, this device is not suited for compound cams, in which the width of the cam can be modified.

In German OS No. 2,029,911, each cam is associated individually with a device for ficticious modification of the cam width as a function of the engine speed. This is obtained by a speed dependent variation of the position of a cam swivel axis eccentric relative to the shaft axis.

U.S. Pat. No. 4,332,222 (corresponding to German patent application P 28 22 147.8) discloses a camshaft arrangement containing apparatus for producing relative displacement between an inner camshaft and a hollow outer camshaft. The adjustment mechanism includes at least one cam plate which is displaceable along a radial guide on the camshaft timing gear. The cam plate is displaced as a function of an engine operating parameter, and includes at least one lateral adjustment curve which controls the position of a follower sensing lever connected with one of the two concentric shafts. A spring acts on the lever to retain the lever in contact with the cam surface. In accordance with this device, using a relatively small number of parts, it is possible to adjust the rotational position of either one or both of the inner shaft and hollow outer shaft relative to the camshaft drive gear, and effect a corresponding adjustment of the cam width or the cam separation. This arrangement permits not only the two shafts to swivel relative to one another, but also permits either or both of the shafts to swivel, and thereby the cams to be advanced or retarded, relative to the top dead center of piston movement. It is also possible in this arrangement to control the position of the inner and outer shafts responsive to more than one engine parameter, for example responsive both to instantaneous engine rpm and engine load.

SUMMARY OF THE INVENTION

The present invention is a camshaft for an internal combustion engine having a pair of concentric shafts pivotable relative to each other through a controllable adjustment mechanism. The separate shafts of the camshaft carry either cams or partial cams, such that the adjustment mechanism varies either the cam peak spacing or the cam width. The adjustment mechanism operates responsive to a parameter representative of engine operation, for example responsive to engine speed or engine load, or responsive to a combination of parameters.

More particularly, the camshaft has a hollow outer shaft with one or more cams or partial cams attached thereon and an inner shaft disposed within the hollow shaft and rotatable relative to the hollow shaft. A camshaft timing gear is coupled to the shafts for driving the camshaft. The inner shaft has one or more cams or partial cams disposed outside the hollow shaft and attached to the inner shaft through clearances in the outer hollow shaft. The adjustment mechanism, responsive to a parameter characteristic of engine operating conditions, is coupled either to the inner shaft or to the outer shaft, or to both, for adjusting the rotational position of the shaft or shafts relative to top dead center of the engine piston, that is, relative to the camshaft timing gear.

The adjustment mechanism includes an electric motor fixed on the timing gear, and apparatus for generating electrical control signals dependent upon the parameter for acting on the motor. A threaded spindle is supported on the timing gear and arranged transversely to the inner and hollow shafts. The spindle is coupled to the output of the motor and meshes with a counter-thread arrangement on either the inner shaft or the hollow outer shaft. Thus, the motor can either advance or retard the coupled inner or hollow outer shaft, depending upon the control signals received.

In one arrangement, the camshaft timing gear is rigidly attached to either the inner or outer shaft, and coupled through the spindle to the adjustable other shaft. Preferably the counter-threads extend over an arc of a circle concentric with the shaft axis.

In another arrangement, both concentric shafts are rotatable relative to the camshaft timing gear. In this arrangement, the camshaft timing gear is connected to the two concentric shafts by a spindle engaging separate counter-threads on each of the two concentric shafts. The spindle is preferably made up of two part spindles having different thread spacing and direction, and engages slide nuts containing the counter-threads, which are linked to rigid arms connected with each of the two concentric shafts.

In accordance with the aforedescribed construction, the relative movements of the two concentric shafts and thereby the cams or partial cams supported thereon, can be affected using a minimum of apparatus and precisely controlled by electronic means. Electronic devices, which by means of sensors receive electrical signals reflecting various operating parameters of the engine have been used increasingly for regulating and controlling internal combustion engines. In accordance with this invention, it is possible to take advantage of such measured parameters and to use the corresponding electronic signals as control signals for regulating the cam timing and width. The present apparatus is also readily adaptable to respond to programed conditions, for example stored inter-relations between various engine operating parameters and influencing variables, and to store curves and performing characteristics for emitting electric control signals based upon several measured parameters representative of engine operating conditions.

Moreover, the present invention employs known components, such as an electric motor and spindle arrangements, which have proven dependability.

In accordance with the invention, the electric motor is reversible by change of polarity. Such motors of this type are well known. Current may be readily supplied to the electric motor using slip rings and sliding contacts such that the motor is free to rotate on the camshaft timing gear.

In accordance with the present invention, the inner and outer shafts may adjust cams in accordance with any desired movement relating to each other and also relative to top dead center. Also, because of the control of the shaft positions using electric control signals, any desired number of parameters may be used alone or in combination, for example engine rpm, engine load, exhaust gas emissions, height above sea level, and so on. When it is desired to use a plurality of parameter inputs for achieving instantaneous control of the cam positions, signals representative of each of the parameters may be combined using known electronic apparatus, for example a microprocessor unit for generating a motor control signal from a stored curve.

For a better understanding of the invention, reference is made to the following detailed description of the preferred embodiments, taken in conjunction with the drawings accompanying the application.

DETAILED DESCRIPTION OF THE PREFERRED EMBODIMENTS

In both of the preferred embodiments illustrated in FIGS. 1–2 and FIGS. 3–4, respectively, only the end portion of the camshaft arrangement, which contains the control mechanism, is illustrated. For simplicity, also, the cams proper, which serve as a valve control in an internal combustion engine in a known fashion, are omitted except in connection with FIG. 1. The presentation of the cams proper as well as the controlled valves has been dispensed with in the remaining figures inasmuch as these structural details are well known and are not required for an understanding of the invention.

Figure 2:
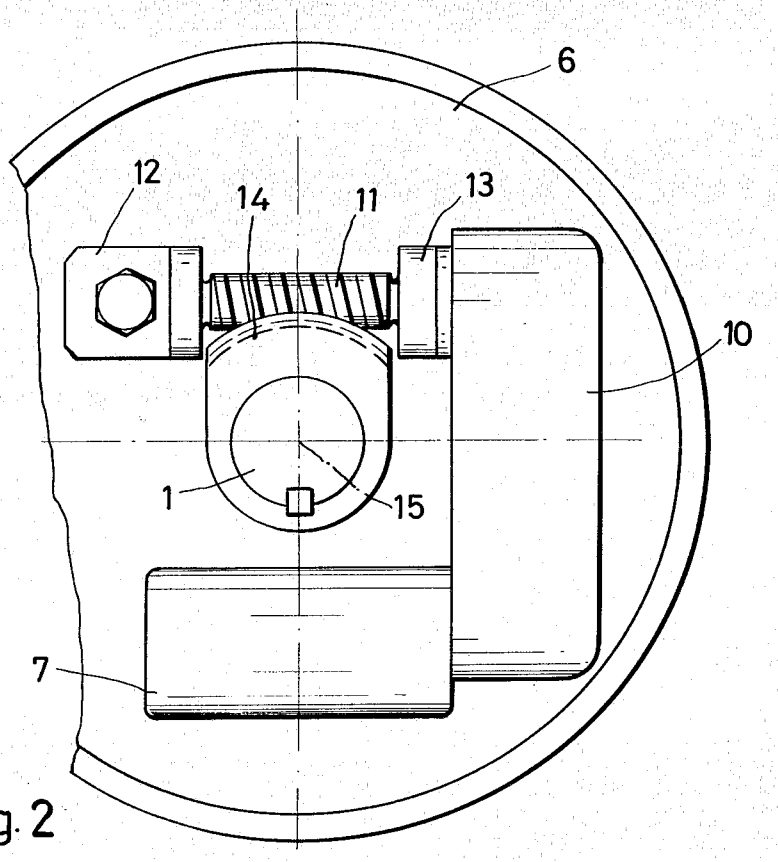
FIG. 2 is a frontal view, also in schematic form, of the embodiment of the invention illustrated in FIG. 1.
Figure 1:
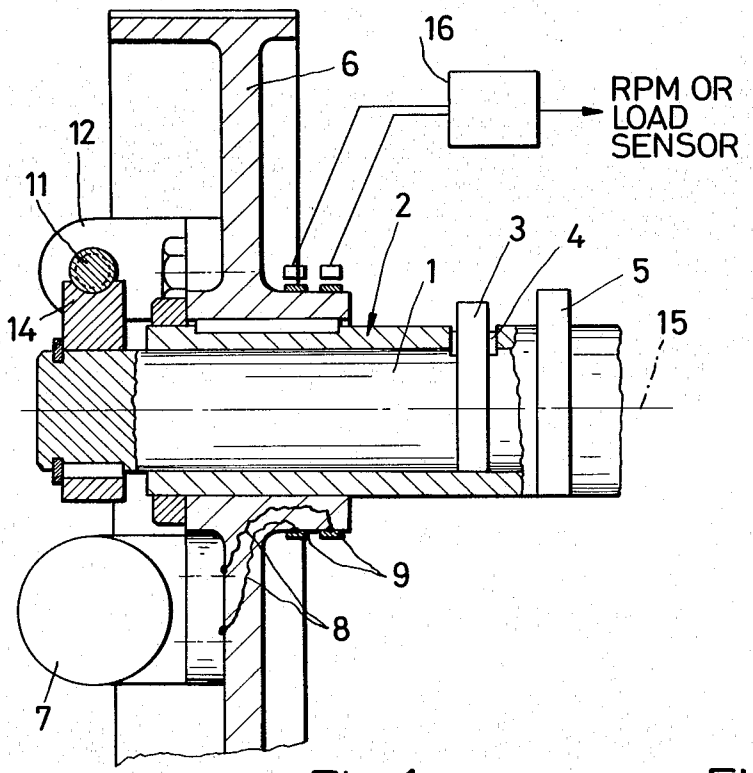
FIG. 1 is a longitudinal sectional view, in schematic form, of a first embodiment of the invention.

Referring to the embodiments shown in FIGS. 1–2, an inner shaft 1 is concentrically surrounded by a hollow outer shaft 2. The shafts 1 and 2 form the camshaft arrangement proper. A cam 3 connected with the inner shaft 1 in a torsion resistant manner passes through a clearance 4 in the outer shaft 2. The outer hollow shaft 2, in turn, carries in a torsion resistant manner a cam 5. In the example shown, the cam 5 actuates a valve other than the valve actuated by cam 3. However, it is possible to arrange several partial cams substantially in a plane perpendicular to the plane of FIG. 1, in which one of the partial cams is connected with the inner shaft 1 and the other partial cam is connected with the outer shaft 2. In this manner, the two partial cams combined would act as a compound cam which, through relative pivoting between the inner 1 and outer 2 shafts, would be of variable width. As used herein, the term "cam-like part" means a cam or a partial cam.

The camshaft is driven by a camshaft timing gear 6, which in the embodiment of FIGS. 1–2 is fixedly attached on the hollow outer shaft 2. The camshaft timing gear 6 is driven in a conventional manner by a timing belt or a toothed gear from the internal combustion engine proper and is synchronized with the crankshaft rotation.

The camshaft timing gear 6 carries on its left-end face, in the orientation shown in FIG. 1, an electric motor 7. The motor 7 is connected electrically, by way of wires 8 and slip rings 9, with stationary sliding contacts cooperating with the slip rings 9. The sliding contacts, in turn, are connected with any suitable electronic controlling device 16 which emits electric control signals for driving the electric motor 7. The electric control signals may be emitted responsive to any desired engine parameter, for example changes in engine rpm or engine load. Accordingly, any such emitted signal would cause the motor to rotate, clockwise or counterclockwise dependent upon the desired adjustment of the cams.

The output of the electric motor 7 drives by way of gearing 10, a threaded spindle 11. The spindle 11 is supported by bearing blocks 12 and 13 on the end face of the camshaft timing gear 6. The threaded spindle 11, in turn, meshes with a counter-threaded arrangement 14 attached in a torsion resistant manner on the inner shaft. The threading of the counter-threaded part 14 is open and extends over the arc of a circle around the axis 15 of the camshafts 1 and 2.

Thus, the camshaft timing gear is rigidly attached to the outer hollow shaft 2 for rotation therewith, but is coupled with the inner shaft 1 by the motor 7, gearing 10, spindle 11 and counter-thread part 14. Accordingly, driving signals delivered to the motor are converted into rotations of the inner shaft 1 relative to the camshaft timing gear 6 and thereby relative to the hollow shaft 2.

Figure 4:
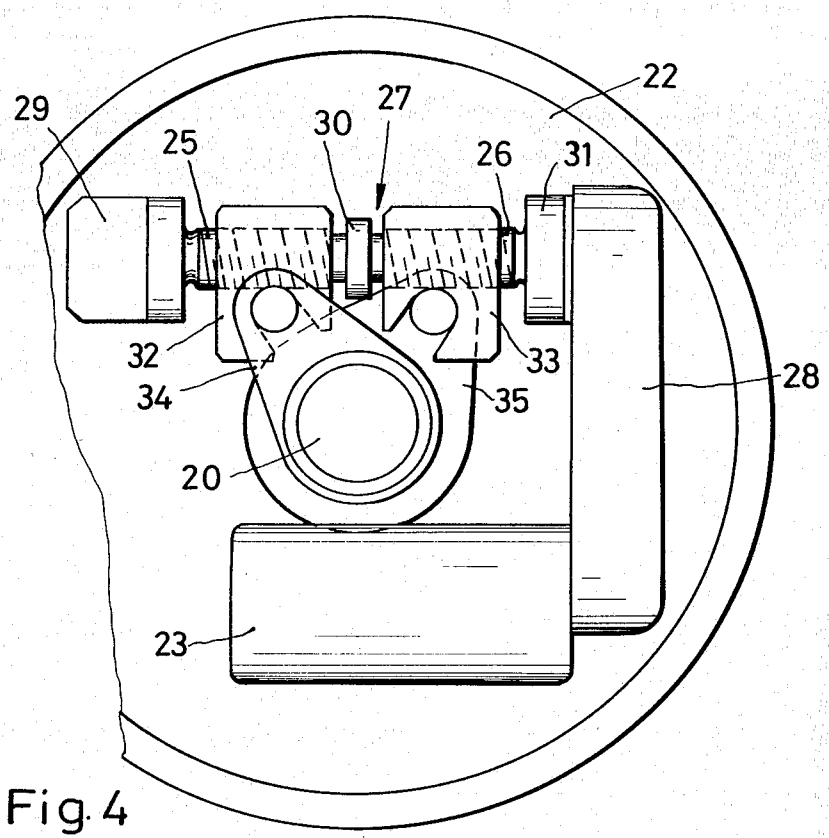
FIG. 4 is a frontal view, in schematic form, of the embodiment of the invention shown in FIG. 3.
Figure 3:
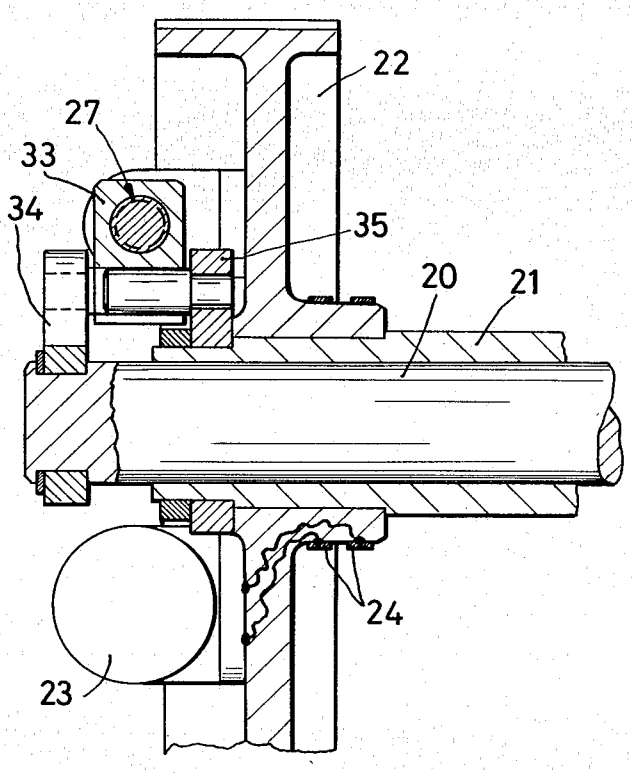
FIG. 3 is a longitudinal sectional view, shown in schematic form, of a second embodiment of the invention.

Referring to FIGS. 3–4, the camshaft includes two concentric shafts 20 and 21 onto which cooperating cams (not shown) are mounted. In this arrangement, both of the shafts 20 and 21 and thereby the associated cams may be rotated relative to the camshaft timing gear 22. In this embodiment, the camshaft timing gear 22 is arranged rotatably on the hollow shaft 21. Thus, in this embodiment, the cams may be advanced or retarded relative to top dead center, and the selection of an appropriate driving spindle, as described below, permits the positioning of the cam or cams on one shaft with complete freedom relative to the cams on the other shaft.

An electric motor 23 is arranged on the camshaft timing gear 22, and again slip rings 24 are provided for introducing driving signals. Torque between the camshaft timing gear 22, driven by the internal combustion engine, and the two concentric shafts 20 and 21 is transmitted by a spindle 27 comprising spindle parts 25 and 26 with threads wound in opposite directions. The electric motor 23 and the gearing 28 to the spindle 27 are supported on the end face of the camshaft timing gear 22. The spindle 27 is supported in bearing blocks 29, 30, and 31, also on the end face of the camshaft timing gear 22. A pair of slide nuts 32 and 33 are disposed on the spindle parts 25 and 26, respectively, and are displaceable in response to rotation of the spindle 27. The slide nuts 32 and 33 are provided with cooperating counter-threading to the threads on the spindle parts 25 and 26, and are connected to arms 34 and 35 attached to the two concentric shafts 20 and 21, respectively, such that axial displacement of the nuts 32 and 33 along the spindle 27 results in advancement or retarding of the respective inner and outer shafts 20 and 21 relative to top dead center.

The use of a threaded spindle 27, divided into two parts 25 and 26 rigidly connected, provides an advantage in that a single electric motor may be used to provide movement for both concentric shafts 20 and 21. Moreover, by selection of appropriate thread spacing and pitch, which may be done independently for spindle parts 25 and 26, the relative angular displacement for the inner and outer shafts 20 and 21 may be selected independently.

The invention has been shown and described with reference to the preferred embodiments thereof. Modifications and variations of the apparatus described herein will be apparent to persons skilled in the art without departing from the inventive concepts disclosed herein. All such modifications and variations are intended to be within the scope of the present invention as defined in the following claims.

I claim:

1. In a camshaft for a drive, preferably an internal combustion engine, having a hollow shaft carrying at least one cam-like part for rotation therewith, an inner shaft disposed within the hollow shaft and rotatable relative to the hollow shaft, the inner shaft having at least one cam-like part disposed outside the hollow shaft attached for rotation with the inner shaft through clearances in the hollow shaft, means for driving the camshaft including a camshaft timing gear coupled with both shafts and means responsive to a parameter characteristic of operating conditions of the drive for adjusting the rotational position of at least one of said inner shaft and said hollow shaft relative to the camshaft drive means, the improvement wherein the adjusting means comprises an electric motor means fixed on said timing gear, means for generating electrical control signals dependent upon said parameter for acting on said motor means, a threaded spindle supported on said timing gear transversely to said shafts and coupled to the output of said motor, and counter threaded means mounted on one of said inner shaft and said hollow shaft for meshing with said threaded spindle.

2. A camshaft arrangement as defined in claim 1, wherein said camshaft timing gear is connected in a torsion resistant manner with the other of said inner and hollow shafts for rotation therewith.

3. A camshaft arrangement as defined in claim 2, wherein said counter thread means includes threads extending over the arc of a circle.

4. A camshaft arrangement as defined in claim 1, comprising a second counter thread means on the other of said inner and hollow shafts, and wherein said threaded spindle engages said second counter thread means for coupling said camshaft timing gear with the other of said inner and said hollow shafts.

5. A camshaft arrangement as defined in claim 4, wherein said threaded spindle comprises two part spindles having different thread configurations, wherein each part spindle meshes with one of said counter thread means and said second counter thread means.

6. A camshaft arrangement as defined in claim 5, wherein said counter thread means and said second counter thread means comprise slide nuts for engaging said spindle, and rigid arms coupled between said slide nuts and said shafts for pivoting said shafts in response to axial displacement of said slide nuts.

* * * * *

UNITED STATES PATENT AND TRADEMARK OFFICE

CERTIFICATE OF CORRECTION

PATENT NO. : 4,517,934

DATED : May 21, 1985

INVENTOR(S) : Stanislav Papez

It is certified that error appears in the above-identified patent and that said Letters Patent is hereby corrected as shown below:

First page, delete Item [63].

Col. 1, delete lines 6-8.

Signed and Sealed this

*Eighth* Day of *October 1985*

[SEAL]

*Attest:*

*Attesting Officer*

DONALD J. QUIGG

*Commissioner of Patents and Trademarks—Designate*